US005372070A

United States Patent [19]

Neidert et al.

[11] Patent Number: 5,372,070

[45] Date of Patent: Dec. 13, 1994

[54] BURN RATE MODIFICATION OF SOLID PROPELLANTS WITH BISMUTH TRIOXIDE

[75] Inventors: Jamie B. Neidert; Robert E. Askins, both of Huntsville, Ala.

[73] Assignee: Thiokol Corporation, Ogden, Utah

[21] Appl. No.: 834,123

[22] Filed: Feb. 10, 1992

[51] Int. Cl.[5] ..... C06B 45/00; C06B 29/04

[52] U.S. Cl. ..... 102/290; 102/272; 149/2; 149/57; 149/85

[58] Field of Search ..... 149/57, 85, 2; 102/290, 102/292

[56] References Cited

U.S. PATENT DOCUMENTS

| | | | |
|---|---|---|---|
| 1,631,070 | 5/1927 | Snelling | 102/290 X |
| 2,938,778 | 5/1960 | Linsk | 102/290 X |
| 3,755,021 | 8/1973 | Sujanski | 149/88 X |
| 3,862,866 | 1/1975 | Timmerman et al. | 149/21 |
| 4,419,153 | 12/1983 | Boberg | 149/85 X |
| 4,853,052 | 8/1989 | Calsson et al. | 149/44 X |
| 5,074,938 | 12/1991 | Chi | 149/88 X |

*Primary Examiner*—Peter A. Nelson
*Attorney, Agent, or Firm*—Madson & Metcalf

[57] ABSTRACT

Propellant formulations are provided which include non-toxic burn rate modifiers. In order to produce a usable propellant formulation, it is necessary to control the burn rate of the propellant. Failure to adequately control the propellant burn rate often results in unacceptable performance of the propellant. For example, during the operation of a rocket motor, or similar device which contains a propellant, the propellant may produce operating pressures which are too high or too low for the intended purpose of the device.

It has often been the practice to add lead to rocket motor propellants in order to modify the burn rate and to maintain the burn rate within acceptable parameters. Lead, however, is known to be toxic and a pollutant. Accordingly, it is desirable to replace the lead in the formulation. It has been found herein that bismuth trioxide is capable of modifying the burn rate of propellants without resorting to lead as a burn rate additive. Accordingly, the use of bismuth trioxide is taught as effective burn rate modifiers in propellants, in order provide non-toxic means for modifying the propellant burn rate.

15 Claims, 1 Drawing Sheet

BURN RATE MODIFICATION OF SOLID PROPELLANTS WITH BISMUTH TRIOXIDE

BACKGROUND

1. The Field of the Invention

The present invention is related to methods and compositions for modifying the burn rate of solid rocket motor propellants, without the addition of expensive, toxic or polluting materials, such as lead or copper. More particularly, the present invention is related to the use of bismuth trioxide to modify the burn rate of solid rocket motor propellants.

2. Technical Background

In the manufacture of solid rocket motors, several components have been found to be required. First there must be an adequate rocket motor case. The rocket motor case forms the exterior of the rocket motor and provides the essential structural integrity for the rocket motor. The rocket motor case is conventionally manufactured from a rigid, yet durable, material such as steel or filament wound composite.

Placed within the interior of the rocket motor case is the propellant grain. The propellant forming the grain is conventionally burned to form thrust within the interior of the rocket motor case. The formation of hot gases upon burning of the propellant, and the subsequent exit of those gases through the throat and nozzle of the case provide the thrust to propel the rocket motor.

There are two major classes of propellants used in conventional applications. These include solid propellants and liquid propellants. Solid propellants are used extensively in the aerospace industry. Solid propellants have developed as the preferred method of powering most missiles and rockets for military, commercial, and space applications.

Solid rocket motor propellants have become widely accepted because of the fact that they are relatively simple to manufacture and use, and they have excellent performance characteristics. Furthermore, solid propellant rocket motors are generally more simple than liquid fuel rocket motors. For all of these reasons, it is found that solid rocket propellants are very reliable and economical.

In some applications, it is important that the rocket motor perform with reduced or eliminated smoke output. For example, in tactical rocket motors, the production of smoke causes a number of disadvantages. The smoke produced may obscure the vision of pilots or drivers of a craft or vehicle firing the tactical rocket. In addition, the production of smoke makes tracking the source of the motor easier, a serious disadvantage during military operations.

An important consideration in solid propellants, including minimum smoke propellants, is means for controlling the burn rate of the propellant, without significantly adding to the smoke output of the propellant. It will be appreciated that it is important that the propellant burn at a controlled and predictable rate. If the burn rate of the propellant can be controlled it is possible to assure proper operation of the rocket motor, or other similar device.

If the propellant achieves an excessively high burn rate, the pressure created within the casing may exceed the design capability of the casing, resulting in damage or destruction to the device. If the propellant does not develop a sufficient burn rate, there may not be sufficient thrust to propellant the rocket motor over the desired course.

Accordingly, it is conventional in the art to add materials to the propellant to control the burn rate of the propellant. Such materials are often referred to as burn rate modifiers. Burn rate modifiers are generally added in order to cause the burn rate of the propellant to "plateau" at an operable level. When burn rate is plotted as a graph of burn rate (for example, in inches per second) on the Y-axis and pressure (in pound per square inches) on the X-axis, the plateau effect results in a flatting of the burn rate curve to a slope more parallel with the X-axis. This plateau effect is desirable in order to achieve a relatively constant pressure output over a chosen period of time.

In order to achieve the plateau effect described above, it has been common practice to add relatively hazardous metals to the propellant. For example, lead is perhaps the most widely used burn rate modifier for certain classes of propellants. Lead, however, is known to be a hazardous, toxic, and polluting metal. Concern with lead pollution in society as a whole is on the rise, and serous health problems are known to be associated with lead poisoning and lead pollution. As a result, concern with lead in the preparation and use of propellants is high, and it is presently preferred that lead be eliminated as a component of solid propellants.

Another significant concern in the formulation of propellants is safety. Because of the fact that propellants are often used in environments where accidental ignition of the propellant is a possibility, preventing accidental ignition is of interest. If a propellant is capable of ignition by being struck by stray bullets or flying debris, the safety hazard is significantly increased. If the propellant will ignite at temperatures typically encountered in hot environments or under normal operating conditions, the usefulness of the propellant is significantly decreased. Thus, it is an object of propellant development to produce effective propellants which are also relatively insensitive to accidental ignition.

Accordingly, it would be a significant advancement in the art to provide methods and compositions for modifying propellant burn rates which avoided some of the significant problems encountered with conventional burn rate modifiers. More particularly, it would be an advancement in the art to provide burn rate modifiers which are not based on lead, copper, or similar materials. Similarly, it would be a related advancement in the art to provide methods and compositions for modifying burn rates in propellants which did not rely on toxic, hazardous, or polluting burn rate additives. It would be a further advancement in the art to provide such propellants which produced a minimum of smoke output when burned. It would be another advancement in the art to provide propellant compositions which are generally insensitive.

Such methods and compositions are disclosed and claimed herein.

BRIEF SUMMARY AND OBJECTS OF THE INVENTION

The present invention is related to methods and compositions for modifying the burn rate of solid rocket motor propellants, without the addition of expensive, toxic, hazardous, or polluting materials, such as lead and copper. More particularly, the present invention is related to the use of bismuth trioxide, to modify the burn rate of a solid rocket motor propellant. The addition of bismuth trioxide has been found to be effective in modifying the burn rate of certain propellants in order to provide a more usable and controllable propellant product.

The present invention has been found particularly effective in controlling the burn rate of propellants containing a combination of nitrate esters and ammonium nitrate. Nitrocellulose, for example, may comprise the nitrate ester component of such propellants. Such propellants are widely used as solid rocket motor propellants.

A propellant of this general type may be formulated as follows:

| Material | Percentage Range |
|---|---|
| Ammonium Nitrate | 20–25 |
| Nitrocellulose | 15–17 |
| BTTN | 39–41 |
| TMETN | 13–15 |

In this propellant formulation BTTN is 1,2,4 butanetrioltrinitrate and TMETN is trimethylolethane trinitrate. This type of propellant is also known to be relatively low in smoke output and, therefore, is desirable for uses where minimum smoke is a significant benefit. In addition, formulations within the ranges set forth above are found to be relatively insensitive to accidental ignition.

While such propellants are widely used as rocket motor propellants, in the absence of burn rate modifiers these propellant compositions are generally found to have high burn rates which render them unusable. In particular, when burn rate is plotted against pressure, the resulting line is of relatively constant slope with burn rate increasing with an increase in pressure.

In order to deal with this problem, the present invention teaches the addition of non-toxic, non-hazardous, and non-polluting burn rate modifiers to nitrate ester-/ammonium nitrate propellants. One such burn rate modifier is bismuth trioxide. It is found the addition of from about 0.5% to about 8.0% bismuth trioxide to propellants of this type results in a much more controllable and usable burn rate over a significant period of operation.

It is, therefore, a primary object of the present invention to provide methods and compositions for modifying propellant burn rates which avoid problems encountered with conventional burn rate modifiers.

More particularly, it is an object of the present invention to provide a burn rate modifier which is not based on lead or similar materials.

It is a related object of the invention to provide methods and compositions for modifying burn rate which do not rely on expensive, toxic, hazardous, or polluting burn rate additives.

It is a further object of the invention to provide such propellants which produce minimum smoke output when burned.

It is another object of the present invention to provide propellants which are generally insensitive to accidental ignition.

These and other objects and advantages of the invention will become apparent upon reading the following detailed description and appended claims, and upon reference to the accompanying drawings.

BRIEF DESCRIPTION OF THE DRAWINGS

In order that the manner in which the above-recited and other advantages and objects of the invention are obtained, a more particular description of the invention briefly described above will be rendered by reference to specific embodiments which are illustrated in the appended drawing. Understanding that the drawing depicts only typical embodiments of the invention and are not, therefore, to be considered limiting of its scope, the invention will be described and explained with additional specificity and detail through the use of the accompanying drawing in which.

DETAILED DESCRIPTION OF THE PREFERRED EMBODIMENTS

Figure 1:
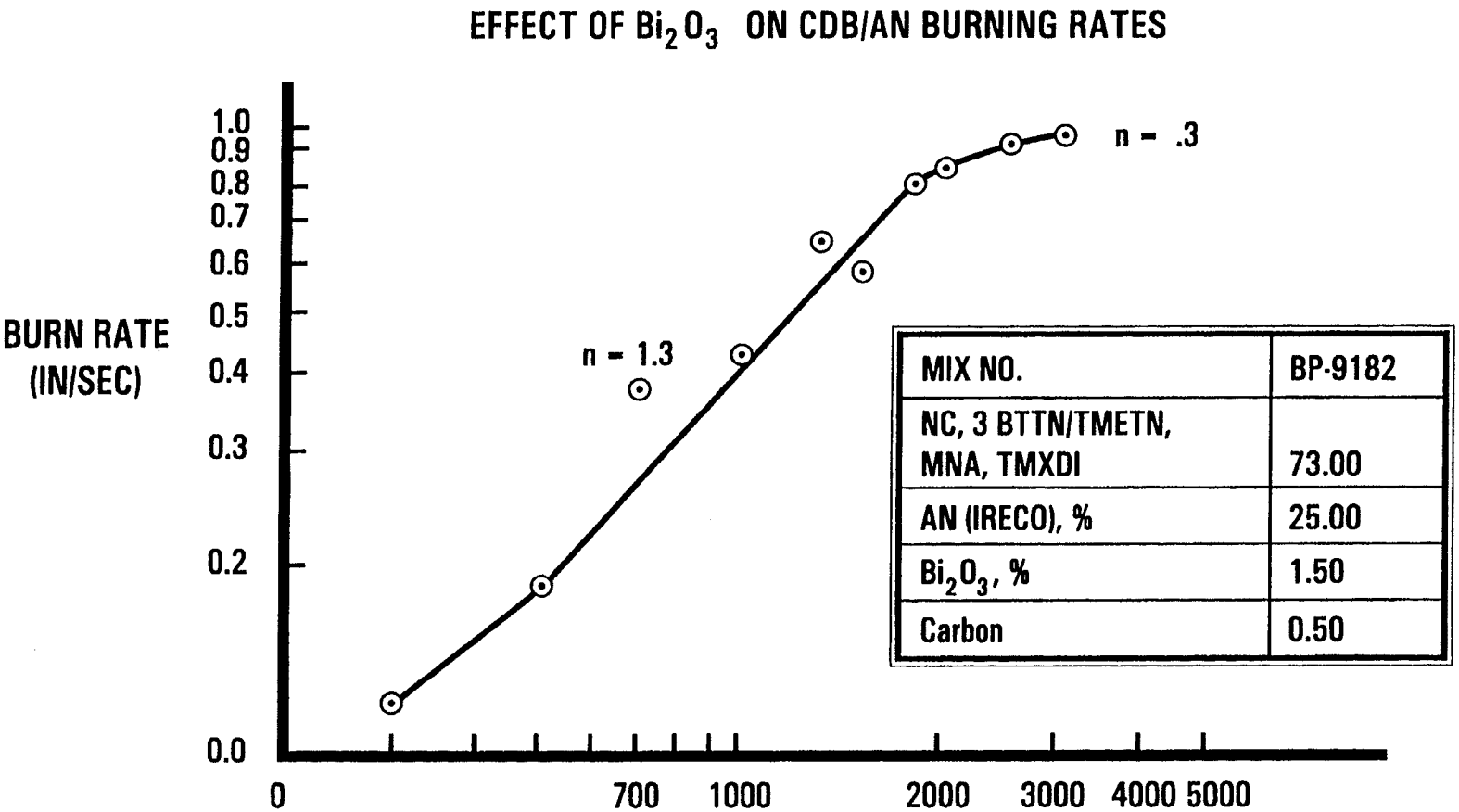
FIG. 1 is a graph plotting burn rate data obtained from a propellant composition within the scope of the present invention.

As mentioned above, the present invention is related to methods and compositions for modifying the burn rate of solid rocket motor propellants, without the addition of expensive, toxic, hazardous, or polluting materials, such as lead and copper.

Specifically, the present invention is related to the use of bismuth trioxide to modify the burn rate of solid rocket motor propellants.

The bismuth trioxide added to the propellant formulation may have a relatively wide range off particle sizes. For example, bismuth trioxide having particle sizes in the range of from about 0.1$\mu$ to about 40$\mu$ fall within the scope of the present invention. It has been discovered, however, that bismuth trioxide having a particle sizes in the range of from about 0.5$\mu$ about 3.0$\mu$ results in a particularly acceptable formulation.

With propellants falling within the scope of the present invention it is presently preferred to add bismuth trioxide to constitute from about 0.5% to about 8.0%, by weight, of the total propellant formulation. More particularly, it is found that propellants having from about 1.0% to about 3.0% bismuth trioxide produce propellants having good performance characteristics.

As mentioned above, the present invention is particularly useful when used with propellant compositions based upon a combination of nitrate esters and ammonium nitrate. It should be appreciated, however, that the present invention may also be found beneficial with other types of propellants such as ammonium perchlorate-based, XLDB, and minimum-smoke (nitrato ester) propellants.

A typical formulation falling within the scope of the present invention may have the following ingredients, in the following percentages (by weight):

| Material | Percentage Range |
|---|---|
| Ammonium Nitrate | 20–25 |
| Bismuth trioxide | 0.5–8 |
| Nitrocellulose | 15–17 |
| Carbon (amorphous) | 0.5–1 |
| BTTN | 39–41 |
| TMETN | 13–15 |
| MNA | 0–1 |

Propellants falling within the scope of the present invention are found to provide excellent burn rate control. In particular, formulations within the scope of the invention result in burn rate v. pressure curves which exhibit a significant "plateau." As mentioned above, the plateau effect provides the ability to control the pressure produced by burning the propellant, and allows one to construct a propellant grain which is suitable for use in a rocket motor casing.

In addition, it is found that the formulations of the present invention exhibit other beneficial characteristics. For example, the propellants of the present invention are generally low smoke. This is a significant benefit, especially when the propellant is to be used in a tactical rocket motor. Low smoke propellants make it more difficult to precisely locate the point from which the rocket motor was fired. In addition, low smoke characteristics assure that visibility is not obstructed at the point of firing.

Furthermore, the propellants are relatively insensitive. This increases the safety of the propellants and provides the ability to use the propellants with confidence, even in hazardous environments such as military operations. Such insensitive propellants are much less likely to be accidently detonated.

EXAMPLES

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

Examples 1

In this Example a propellant within the scope of the present invention was prepared, burned, and characterized. The propellant had the following weight percentage compositions:

| Composition | |
|---|---|
| Material | Percentage |
| Ammonium Nitrate | 25.0 |
| Preblend | 73.0 |
| Bismuth trioxide | 1.50 |
| Carbon | 0.50 |

It was found that the formulation set forth above produced an acceptable low-smoke propellant.

The propellant formulation was burned and the burn rate of the propellant formulation was plotted against the pressure. The results of that plot are set forth in FIG. 1. It can be seen from FIG. 1 that the slope of the plot of the propellant within the scope of the invention plateau significantly. The propellant of the present invention would be acceptable for use as a rocket motor propellant.

This indicates that the burn rate of the propellant is effectively modified by the addition of bismuth trioxides. The burn rate v. pressure is well within the range required for a usable propellant formulation. In addition, these data indicate that acceptable propellants are formed with bismuth trioxides in the 0.5μ to 8.0μ range.

Example 2

In this Example a propellant within the scope of the present invention is prepared. The propellant has the following weight percentage compositions:

| Composition | |
|---|---|
| Material | Percentage |
| Ammonium Nitrate | 25.0 |
| Preblend | 72.0 |
| Bismuth trioxide | 3.0 |

It is found that the formulation set forth above produces acceptable low-smoke propellants have an acceptably modified burn rate.

SUMMARY

In summary, the present invention provides methods and compositions for controlling the burn rate of solid rocket motor propellants. More particularly, the burn rate of nitrate ester/ammonium nitrate propellants have been shown to be controlled by the addition of from about 0.5 to about 3.0% bismuth trioxide.

By formulating the propellants as taught by the present invention it is possible to avoid some of the significant problems encountered with conventional burn rate modifiers. In particular, the present invention provides compositions and methods for modifying burn rate without the use of lead, copper, or similar materials. The burn rate is modified by the addition of bismuth trioxide, which is not toxic, hazardous, or polluting.

The propellant formulation produced is a minimum smoke propellant which is also generally insensitive. Thus, the major objects of the present invention are met by the compositions and methods of the present invention.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A solid propellant matrix having a non-toxic burn rate modifier, said burn rate modifier comprising bismuth trioxide.

2. A solid propellant matrix having a non-toxic burn rate modifier as defined in claim 1 comprising from about 0.5% to about 8.0% bismuth trioxide.

3. A solid propellant matrix having a non-toxic burn rate modifier as defined in claim 1 comprising from about 1.0% to about 3.0% bismuth trioxide.

4. A solid propellant matrix having a non-toxic burn rate modifier as defined in claim 1 wherein a sufficient quantity of bismuth trioxide is added to produce a plateau of the burning rate v. pressure curve of the propellant.

5. A solid propellant matrix having a non-toxic burn rate modifier as defined in claim 1 wherein said solid propellant matrix comprises a nitrate ester/ammonium nitrate propellant.

6. A solid propellant matrix having a non-toxic burn rate modifier as defined in claim 1 wherein said bismuth trioxide has a particle size in the range of from about 0.1μ to about 40μ.

7. A solid propellant having a modified burn rate comprising:

from about 10% to about 25% Ammonium Nitrate;

from about 15% to about 17% nitrate ester;
from about 39% to about 41% BTTN;
from about 13% to about 15% TMETN
from about 1.0% to about 3.0% bismuth trioxide.

8. A solid propellant having a modified burn rate as defined in claim 7 further comprising from about 0.5% to about 8.0% bismuth trioxide.

9. A solid propellant having a modified burn rate as defined in claim 7 further comprising from about 0% to about 1.0% MNA.

10. A solid propellant having a modified burn rate as defined in claim 7 wherein said bismuth trioxide has a particle size in the range of from about 0.1$\mu$ to about 40$\mu$.

11. A method for modifying the burn rate of a solid nitrate ester/ammonium nitrate propellant comprising the step of adding to the propellant an effective quantity of bismuth trioxide.

12. A method for modifying the burn rate of a solid nitrate ester/ammonium nitrate propellant as defined in claim 11 wherein bismuth trioxide is added such that it comprises from about 0.5% to about 8.0% by weight of the propellant.

13. A method for modifying the burn rate of a solid nitrate ester/ammonium nitrate propellant as defined in claim 11 wherein bismuth trioxide is added such that it comprises from about 1.0% to about 3.0% by weight of the propellant.

14. A method for modifying the burn rate of a solid nitrate ester/ammonium nitrate propellant as defined in claim 11 wherein a sufficient quantity of bismuth trioxide is added to produce a plateau of the burning rate v. pressure curve of the propellant.

15. A method for modifying the burn rate of a solid nitrate ester/ammonium nitrate propellant as defined in claim 11 wherein said bismuth trioxide has a particle size in the range of from about 0.5$\mu$ to about 40$\mu$.

* * * * *